US006502736B2

(12) United States Patent
Dittrich et al.

(10) Patent No.: US 6,502,736 B2
(45) Date of Patent: Jan. 7, 2003

(54) HOLDER FOR A DRIVE PISTON OF A SETTING TOOL

(75) Inventors: Tilo Dittrich, Gisingen (DE); Markus Frommelt, Schaan (DE)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 10/072,715

(22) Filed: Feb. 6, 2002

(65) Prior Publication Data

US 2002/0108990 A1 Aug. 15, 2002

(30) Foreign Application Priority Data

Feb. 9, 2001 (DE) ..... 101 05 885

(51) Int. Cl.[7] ..... B65C 1/14
(52) U.S. Cl. ..... 227/10; 227/130; 173/211
(58) Field of Search ..... 227/9, 10, 11, 227/130; 173/210, 211

(56) References Cited

U.S. PATENT DOCUMENTS 4,867,365 A * 9/1989 Buechel et al. ..... 227/9
4,941,391 A * 7/1990 Ehmig et al. ..... 227/10
5,538,172 A * 7/1996 Jochum et al. ..... 227/130
5,797,534 A * 8/1998 Almeras et al. ..... 227/10
5,881,940 A * 3/1999 Almeras et al. ..... 227/10
6,092,710 A * 7/2000 Kersten ..... 173/211
6,123,243 A * 9/2000 Pfister et al. ..... 227/10

* cited by examiner

*Primary Examiner*—Scott A. Smith
(74) *Attorney, Agent, or Firm*—Sidley Austin Brown & Wood, LLP

(57) ABSTRACT

A piston holder for drive piston (8) of a setting tool and including at least one friction member for applying pressure to a circumferential surface of the drive piston and having an adjusting surface (17, 24) remote from the drive piston (8) and rising toward a rear, in a setting direction of the setting tool, end of the drive piston, and a pressure element (19, 7') stationary with respect to an axial direction of the drive piston (8) and which is always in a pressure contact with the adjusting surface (17).

15 Claims, 3 Drawing Sheets

HOLDER FOR A DRIVE PISTON OF A SETTING TOOL

BACKGROUND OF THE INVENTION

1. Field of the Invention

Figure 1:
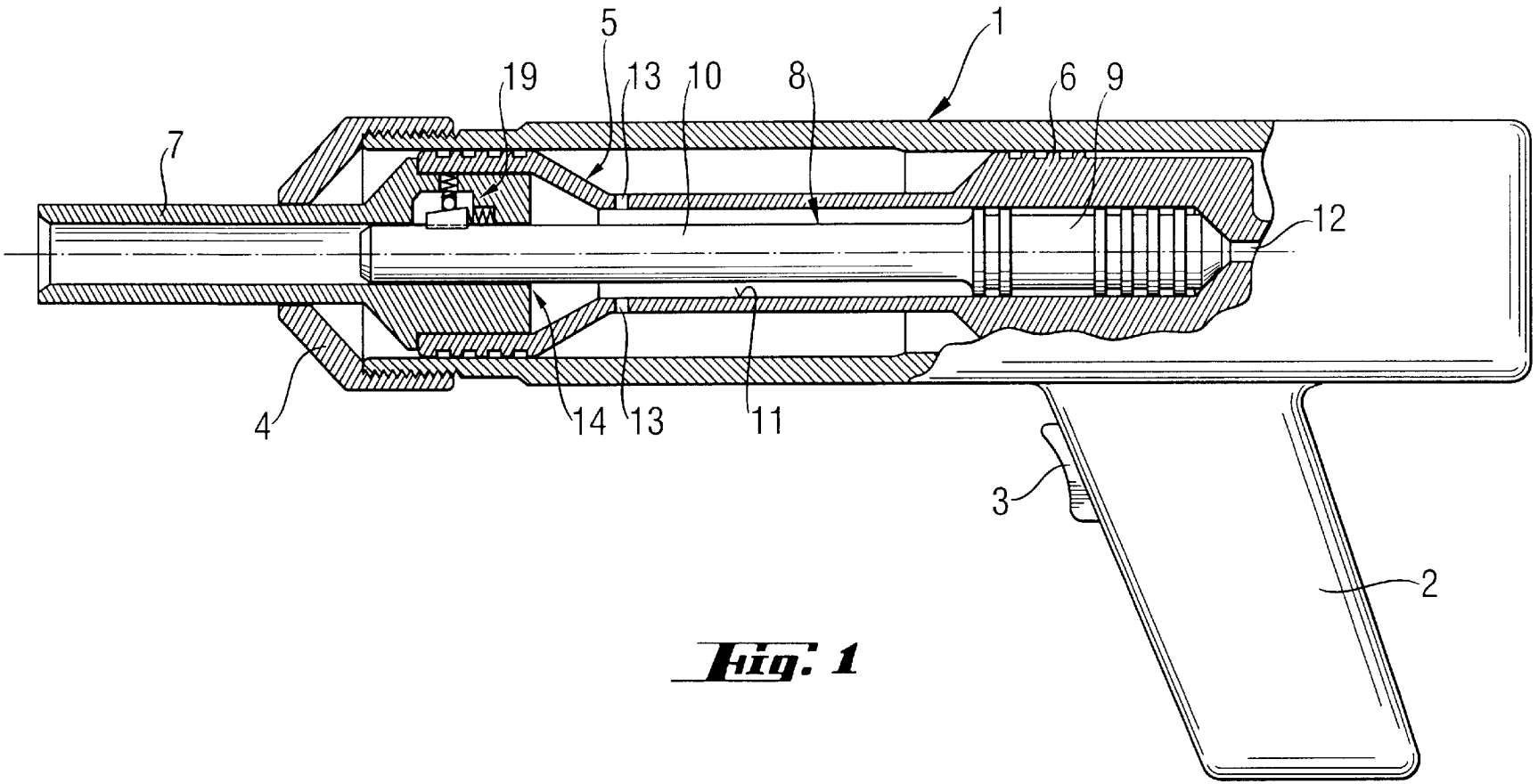

The present invention relates to a holder for a drive piston of a setting tool.

2. Description of the Prior Art

European Publication EP-O 346275 B1 discloses an explosive powder charge-operated setting tool including a piston guide and a drive piston displaceable in the piston guide. In the setting tool, there are provided braking balls for engaging the drive piston and a spring for biasing the braking balls into engagement with the drive piston. The spring is formed as a ring spring for generating a biasing force acting in a radial, with respect to the axial extent of the drive piston direction, on the braking balls. The ring spring is provided on its inner profile with a bearing surface acting on the braking ball. The bearing surface is inclined to the piston at an acute angle that opens in a direction opposite a setting direction. When the driving piston moves in the setting direction, it entrains the braking balls therewith. The braking balls expand the ring spring, which results in the bearing surface transmitting the radial biasing force to the braking balls and, thereby, to the drive piston.

In the ignition-ready position of the drive piston, the braking balls engage, under the biasing force of the ring spring, the body of the drive piston. Upon displacement of the drive piston, as a result of the firing of the setting tool, in the drive-out or setting direction, the drive piston, at the start of its movement, entrains the braking balls with it, rolling them over. As discussed, the braking balls expand the ring spring, and the bearing surface applies to the braking balls a radial biasing force of the ring spring, which is divided in components acting in direction opposite to the setting direction and radially, with respect to the drive piston. The radially displaced, under the action of the biasing force, braking balls are pressed against the piston body, braking the same. Even after a short displacement of the drive piston rearwardly, the braking effect can be lifted, with the braking balls rolling back, releasing the tensioning of the spring. Upon release of the ring spring, it does not bias the balls anymore toward the drive piston. Further, a possibility still remains that the drive piston would be displaced, before ignition or firing of the setting tool, in the setting direction as a result of, e.g., the setting tool being pressed hard against a constructional component. In this case, the displacement of the drive piston in the return direction is effected due to cooperation of the ring spring with the braking balls.

U.S. Pat. No. 4,162,033 discloses a setting tool with a braking device that continuously applies a braking force to the drive piston.

An object of the present invention is to provide a piston holder having a simplified design and which would reliably retain the drive piston in its ignition-ready position in the absence of ignition.

SUMMARY OF THE INVENTION

This and other objects of the present invention, which will become apparent hereinafter, are achieved by providing a piston holder for a drive piston of a setting tool and including at least one friction member for applying pressure to a circumferential surface of the drive piston and having an adjusting surface remote from the drive piston and rising toward a rear, in a setting direction of the setting tool, end of the drive piston, and a pressure element stationary with respect to an axial direction of the drive piston and which is always in a pressure contact with the adjusting surface.

The pressure element insures that the friction member is in a constant contact with the drive piston. The friction member is primarily located in the region of the drive piston body. However, the friction member can be positioned somewhere else with respect to the circumferential surface of the drive piston. When the drive piston, upon actuation of the setting tool, is displaced in the setting direction, it entrains therewith the friction member. As a result, the inclined, in the setting direction adjusting surface is pressed more strongly against the pressure element, whereby the friction between the friction member and the drive piston increases. However, this friction is overcome when the setting tool driving energy reaches its maximum, and the drive piston is able to drive in a fastening element, e.g., in a constructional component or any other object. When the drive piston returns to its initial position, it again entrains the friction member therewith. However, in this case, due to inclination of the adjusting surface in the direction opposite to the direction of movement of the drive piston, the pressure acting between the pressure element and the friction member is reduced significantly, so that during the return movement of the drive piston, the friction between the friction member and the drive piston is reduced practically to a minimum. Still, some friction between the friction member and the drive piston remains, so that the latter can be reliably held in its ignition-ready position. This is insured by a constant contact of the friction with the pressure element.

According to the present invention, the friction member can extend only over a portion of the circumference of the drive piston and be formed as a wedge or a cone, with the adjusting surface being formed as a wedge or conical surface. During the movement of the drive piston in the setting direction or back to its ignition-ready position, the pressure element will run up or down, respectively, over the adjusting surface, providing for the above-described friction action between the friction member and the drive piston. For increasing the friction effect, several friction members and associated therewith, pressure elements can be arranged along the drive piston circumference at a substantially same angular distance therebetween.

The friction member can be formed as a rigid body, with a non-rigid arrangement of the pressure element. Also as a friction member, a wedge or conical body can be used. In this case, the pressure element can be formed as a leaf spring, compression spring, elastomeric spring, or as a ring spring. When the pressure element is formed as a ring spring. When the pressure element is formed as a ring spring, it can apply pressure to several friction members. Pressure contact members can be provided between the above-mentioned pressure elements and the friction members in order to reduce friction between the pressure element and the adjusting surface of the friction member. As a pressure contact member, e.g., a bolt, which extends in a tangential, with respect to the drive piston, direction, can be used. The bolt can be supported sidably or rotatably. When a bolt is used, it will be displaced upwardly and downwardly with the displacement of the drive piston in the setting and opposite directions, respectively, to provide for the desired friction action between the friction member and the drive piston.

According to another embodiment of the present invention, the adjusting surface of the friction member can be formed non-rigid, with stationary or fixed positioning of the pressure element. Thus, e.g., the friction member can be formed of an elastic material or be connected with a suitably inclined, elastic adjusting surface. In this case, the pressure element can have only, e.g., a radially stationary positioned bolt extending tangentially with respect to the drive piston.

In accordance with a still further embodiment of the present invention, the friction member can be formed as a conical spring sleeve, with the pressure element having an inner cone for receiving the spring sleeve. The conical spring sleeve, which is always in a pressure contact with the inner cone, will be pressed against the inner cone more or less strongly, dependent on whether the drive piston moves, respectively, in the setting or opposite direction, with an accompanying increase or decrease of friction between the spring sleeve and the drive piston. In this case also, the previously described change of the friction force action between the friction member and the drive piston would be retained, with the drive piston being reliably held in its ignition-ready position.

The conical spring sleeve can be provided with axial slots in order to obtain a better effect, or be formed of several sections.

In addition, the conical spring sleeve can be bent downwardly at its narrow end, or be provided at this end with a meander shape to form an elastic pressure region that would apply permanently pressure to the drive piston in the radial direction. This insures a minimal friction between the spring sleeve and the drive piston. In this case also, axial slots can be formed in the spring sleeve to improve elasticity in the sleeve pressure region.

In order to retain a contact between the friction member and the pressure element, according to a further development of the present invention, there is provided a spring element for biasing the friction member in the axial direction. This spring element insures further reduction of friction between the friction member and the drive piston. The spring element is designed for insuring a constant contact between the friction member and the pressure element when the drive piston entrains the friction member during its movement to its initial, ignition-ready position.

To this end, the movement of the friction member in the direction toward the rear end of the drive piston can be limited by a stop. In this case, the axially acting spring element can be dispensed with.

The novel features of the present invention which are considered as characteristic for the invention, are set forth in the appended claims. The invention itself, however, both as to is construction and its mode of operation, together with additional advantages and objects thereof, will be best understood from the following detailed description of preferred embodiments, when read with reference to the accompanying drawings.

Figure 3:
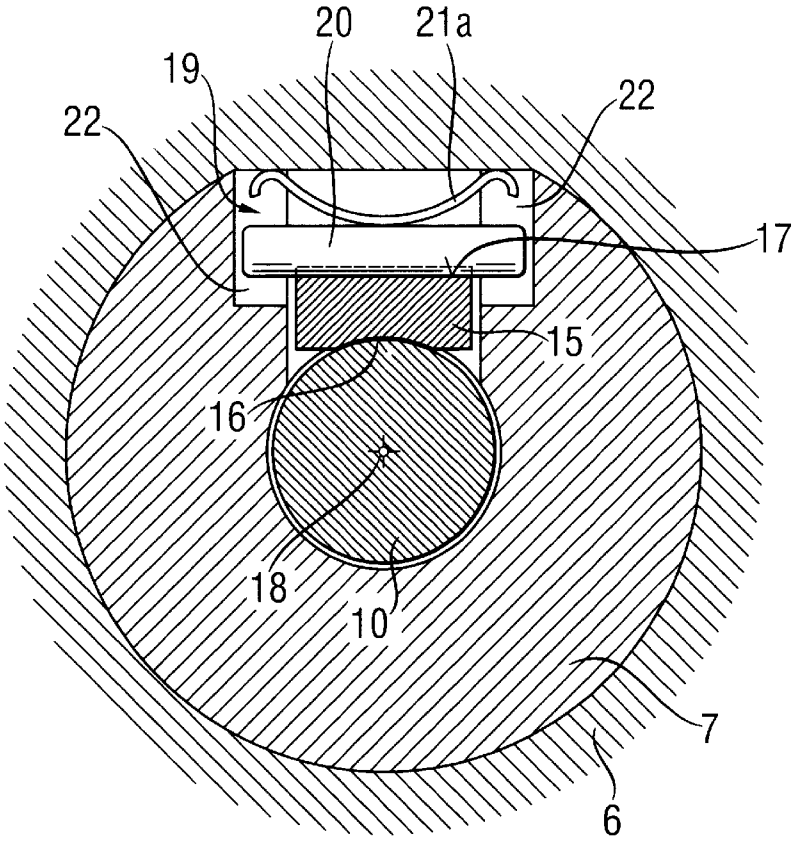
Figure 2:
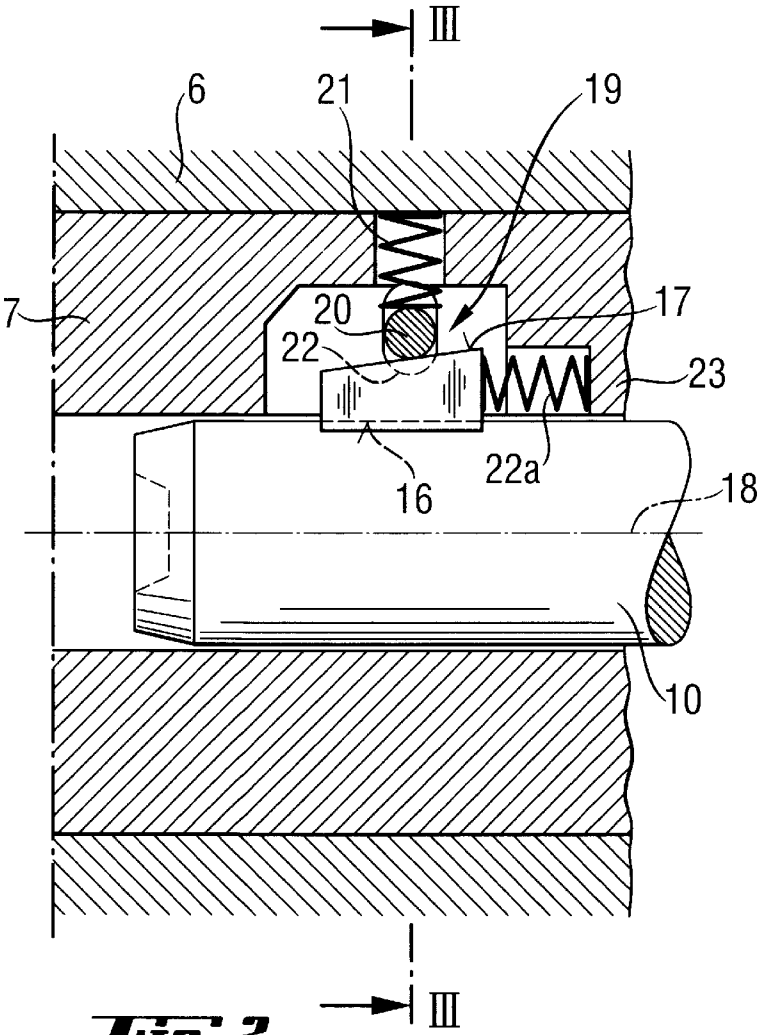
Figure 4:
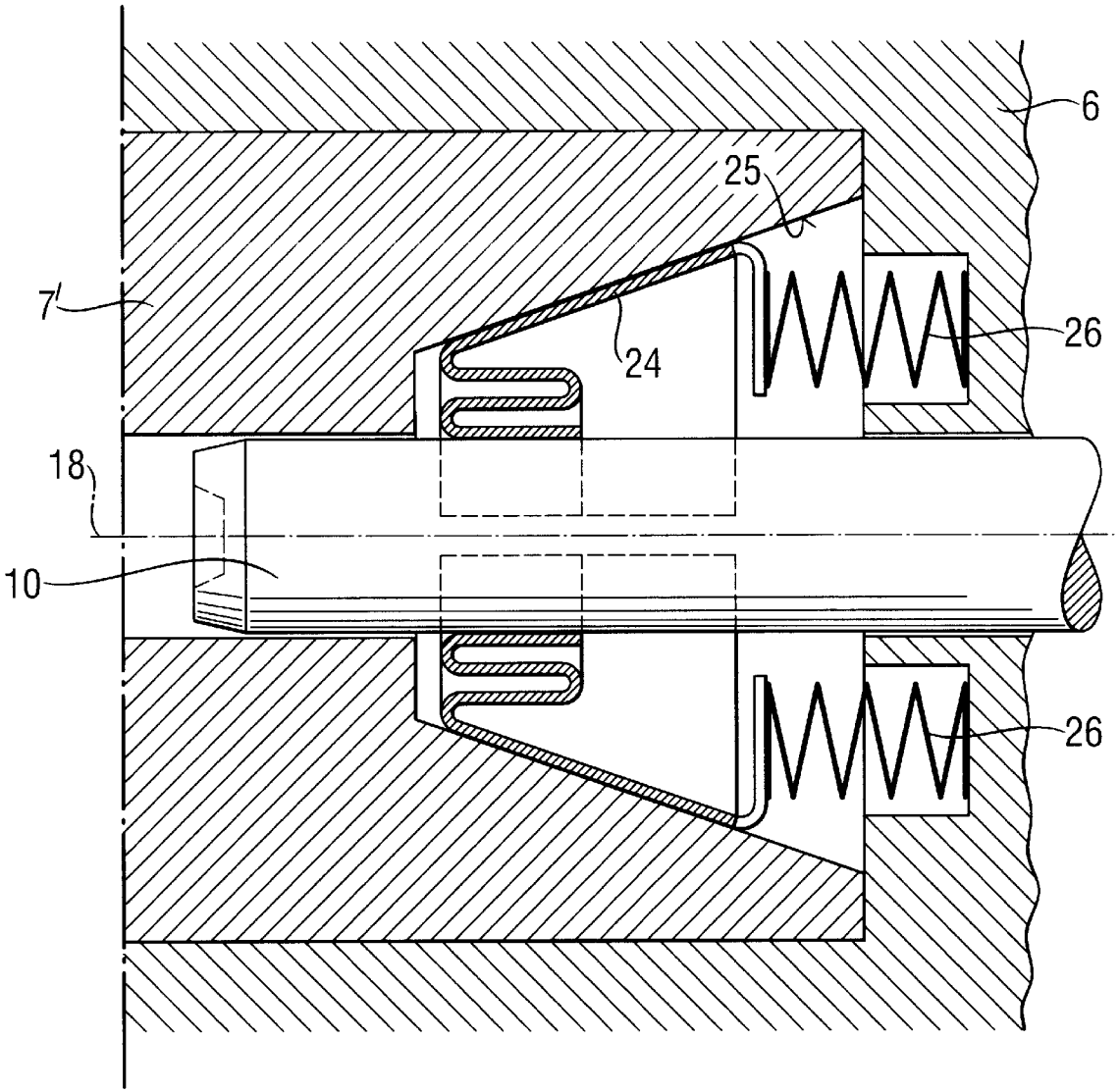

BRIEF DESCRIPTION OF THE DRAWINGS: The drawings show:

FIG. 1 a partially cross-sectional view of a setting tool that can be equipped with a piston holder according to the present invention;

FIG. 2 a side cross-sectional view of a first embodiment of a piston holder according to the present invention;

FIG. 3 a longitudinal cross-sectional view of a piston holder according to a second embodiment of the present invention; and FIG. 4 a side cross-sectional view of a third embodiment of a piston holder according to the present invention.

DETAILED DESCRIPTION OF THE PREFERRED EMBODIMENT

A piston holder according to the present invention can be used with a setting tool a partially cross-sectional view of which a shown in FIG. 1. The setting tool, which is shown in FIG. 1, is an explosive power charge-operated tool. However, the inventive piston holder can also be used in a setting tool driven upon ignition of an air-fuel mixture.

The setting tool, which is shown in FIG. 1, has a housing 1 with a handle 2 and a trigger 3 which, in the embodiment shown in FIG. 1, is provided in the handle. A stop socket 4 is screwed to the housing 1 at the housing end facing in the setting direction of the setting tool. A two-part piston guide 5 is displaceably arranged in the housing 1. The piston guide 5 is formed of rear and front parts 6 and 7, respectively. A drive piston 8 is arranged in the piston guide 5. The drive piston 8 has its head 9 displaceable in the rear part 6 and its body 10 displaceable in the front part 7. An inflow channel 12 for explosion gas of an explosive power charge opens into guide bore 11 of the part 6 at the rear end of the bore 11. At its front end, the part 6 has breakthroughs 13 for releasing air, which is accumulated in front of the piston head 9 of the piston 8 in the piston drive-out or setting direction. The front end region of the rear part 6 concentrically overlaps the rear region of the front part 7. The front part 7 extends beyond the stop socket 4 in the setting direction and forms a delivery tube. The rear end of the front part 7 can extend in form of a tubular projection into the guide bore 11, forming a stop limiting the travel of the drive piston 8.

The piston holder according to present invention can be located in a receiving region 14 formed in the connection region of the front and rear parts 6 and 7.

The particularities of the inventive piston holder are shown in FIGS. 2–4.

In the embodiment shown in FIGS. 2–3, the piston holder includes a friction member 15 located in the front region of the piston body 10 of a drive piston 8. At its bottom side, the friction member 15 has a cylindrical surface 16 the radius of which corresponds to the radius of the piston body 10. The friction member 15 contacts with its cylindrical surface 16, the profile of which corresponds to that of the circumferential surface of the piston body 10, the circumferential surface of the piston body 10. The friction member 15 extends over a small region of the piston body 10 in the circumferential direction of the piston body 10. The friction member 15 has, at its side opposite the opposite a cylindrical surface 16, an adjusting flat surface 17. The adjusting surface 17 is inclined to the longitudinal axis 18 of the piston body 10 so that the distance of the adjusting surface 17 from the axis 18 increases toward the rear end of the piston body 10. Thus, a wedge-shaped member is arranged on the piston body 10 with its narrow face facing toward the front end of the piston body 8.

A pressure element 19 applies pressure to the adjusting surface 17. The pressure element 19 includes a pressure contact member 20 and a spring 21. The pressure contact member 20 is formed as a rotatable bolt lying on the adjusting surface 17 and extending in a direction transverse to the longitudinal axis 18 of the piston body 10. The opposite ends of the bolt-shape, pressure contact member 20 can be received in respective holes 22. The holes 22 permit displacement of the pressure contact member 20 away from the piston body 10. The bolt-shaped, pressure contact member 20 is biased against the adjusting surface 17 by the spring 21. The spring 21 is supported, at one of its end, against the pressure contact member 20 and, at another of its ends, against the rear part 6 of the piston guide 5.

The embodiment of FIG. 3 differs from that of FIG. 2 in that a leaf spring 21*a* replaces the helical spring.

In order to insure contact of the friction member 15 with the pressure contact member 20, the friction member 15 is biased toward the contact member 20 by an axially acting compression spring 22*a*. The compression spring 22*a* is supported, at one of its ends, against a surface of the friction member 15 facing the head of the drive piston 8, and is supported, at another of its ends, against a stop 23. In FIG. 2, the stop 23 is provided in the front part 7. However, the stop can also be carried by the rear part 6.

In FIGS. 2–3, the drive piston 8 is shown in its ignition-ready position. In this position of the drive piston 8, a minimum friction force acts between the friction member 15 and the piston body 10 due to the action of springs 21(21*a*) and 22. However, this friction force is sufficient for reliably holding the drive piston 8 in its ignition-ready position.

When, upon ignition of the setting tool, the drive piston is displaced in the setting direction, the friction force between the friction member 15 and the piston body 10 increases, due to inclination of the adjusting surface 17, until this increased friction force is overcome upon the driving energy reaching its maximum, with the drive piston 8 being able now to advance a fastening element into a constructional component. When the drive piston 8 is returning to its initial, ignition-ready position. It entrains the friction member 15 with it. The displacement of the friction member 15 in the direction opposite the setting direction leads to lowering of the pressure contact member 20 and, thereby, to the release of the spring 21. As a result, friction between the friction member 15 and the piston body 10 is again reduced to its minimum.

The spring 22*a* insures a permanent contact of the adjusting surface 17 with the pressure contact member 20 even in the ignition-ready position of the drive piston 8. In order for the spring 22*a* to be able to insure that the friction member 15 is not displaced from the region of the pressure contact member 20 when the drive piston 8 returns to its initial position, another stop (not shown) can be provided for the spring 21.

If a plurality of friction member 15 is arranged over the circumference of the piston body 10, the springs 21 and 21*a* can be replaced by a ring spring that would circumscribe all of the friction members 15, biasing them against the piston body 10.

In the embodiment of an inventive piston holder shown in FIG. 4, the friction member is formed as a conical spring sleeve 24, and the rear end of the front part 7, which forms the pressure member $7^1$ has an inner cone 25, the profile of which correspond to that of the spring sleeve 24 which is received in the cone 25. An axially acting compression spring 25 slightly biases the spring sleeve 24 into the cone 25, so that the spring sleeve 24 applies, at its front, narrow end, pressure to the piston body 10, to its front end, in the ignition-ready position shown in FIG. 4. The front end of the spring sleeve 24 applies a constant pressure to the piston body 10 in the radial direction, insuring that the drive piston 8 is held in its ignition-ready position. The applied pressure is determined by the biasing force of the spring 26 and the elastic properties of the front region of the spring sleeve 24. The front end of the spring sleeve 24 can have, as shown in FIG. 4, a shape of a meander in the radial direction. Peaks and valleys of the front end of the spring sleeve 24 are concentric with the longitudinal axis 18 of the piston body 10. For a better resilient action, axial slots, which can be, e.g., stamped out, can be provided over the circumference of the spring sleeve 24.

Upon displacement of the drive piston in the setting direction, the friction force between the conical spring sleeve 24 and the piston body 10 increases because with the forward movement of the piston body 10, the spring sleeve 24 is pressed into the inner cone 25. When the drive energy, as result of the ignition action, reaches its maximum, the increased friction force is overcome, and the drive piston 8 can be driven in the setting direction.

Upon return movement of the drive piston 8, conical spring sleeve 24 is also displaced in the direction opposite the setting direction, toward the rear end of the drive piston 8, becoming less stressed. As a result, the friction between the spring sleeve 24 and the piston body 10 decreases to the predetermined minimum, and the drive piston 8 returns to its initial, ignition-ready position substantially friction-free. In this position of the drive piston 8, it is reliably held by the spring sleeve 24 due to the action of the compression spring 26. The displacement of the drive piston 8 in the setting direction, without ignition of the setting tool, is not possible.

Though the present invention was shown and described with references to the preferred embodiments, such are merely illustrative of the present invention and are not to be construed as a limitation thereof, and various modifications to the present invention will be apparent to those skilled in the art. It is, therefore, not intended that the present invention be limited to the disclosed embodiment or details thereof, and the present invention includes all of variations and/or alternative embodiments within the spirit and scope of the present invention as defined by the appended claims.

What is claimed is:

1. A piston holder for a drive piston (8) of a setting tool, comprising at least one friction member (15, 24) for applying pressure to a circumferential surface of the drive piston and having an adjusting surface (17, 24) remote from the drive piston (8) and rising toward a rear, in a setting direction of the setting tool, end of the drive piston; and a pressure element (19, 7') stationary with respect to an axial direction of the drive piston (8) and which is always in a pressure contact with the adjusting surface (17,24).

2. A piston holder according to claim 1, wherein the at least one friction member (15) extends over a portion of a circumference of the drive piston (8).

3. A piston holder according to claim 2, wherein the friction member (15) is formed as a rigid body, and the pressure element (19) has a non-rigid support.

4. A piston holder according to claim 2, wherein the adjusting surface (17) of the friction member (15) is formed as non-rigid surface, and the pressure element (19) is fixedly secured.

5. A piston holder according to claim 1, wherein the pressure element (19) comprises a bolt (20) extending in a tangential direction with respect to the drive piston (8).

6. A piston holder according to claim 5, where in the bolt (20) is supported for rotation about a longitudinal axis thereof.

7. A piston holder according to claim 1, wherein the adjusting surface is formed as one of a wedge surface and a conical surface.

8. A piston holder according to claim 1, wherein a plurality of friction members (15), each of which is associated with a respective pressure element, are arranged over a circumference of the drive piston.

9. A piston holder according to claim 1, wherein the friction member is formed as a conical spring sleeve (24), and the pressure element (7') has an inner core (25) for receiving the spring sleeve (24) and having a profile corresponding to that of the spring sleeve.

10. A piston holder according to claim 9, wherein the spring sleeve (24) is provided with axial slots.

11. A piston holder according to claim 9, wherein the spring sleeve (24) is formed of several sections.

12. A piston holder according to claim 9, wherein the spring sleeve (24) has a meander-shaped front end in the radial direction that contacts the drive piston (8).

13. A piston holder according to claim 1, further comprising spring means (22, 26) for biasing the friction member (15, 24) in an axial direction of the drive piston (8) toward the pressure element (19, 7').

14. A piston holder according to claim 1, further comprising a stationary stop for limiting displacement of the friction member (15, 24) in a direction toward a rear end of the drive piston (8).

15. A piston holder according to claim 1, wherein in the friction member (15, 24) is arranged in a region of the piston body (10) of the drive piston (8).

* * * * *